US006620505B1

(12) United States Patent
Abe et al.

(10) Patent No.: US 6,620,505 B1
(45) Date of Patent: Sep. 16, 2003

(54) POLY(TRIMETHYLENE TEREPHTHALATE) MODIFIED CROSS-SECTION YARN

(75) Inventors: Takao Abe, Nobeoka (JP); Yoichiro Azuma, Nobeoka (JP); Tadashi Koyanagi, Nebeoka (JP)

(73) Assignee: Asahi Kasei Kabushiki Kaisha, Osaka (JP)

( * ) Notice: Subject to any disclaimer, the term of this patent is extended or adjusted under 35 U.S.C. 154(b) by 0 days.

(21) Appl. No.: 10/069,373

(22) PCT Filed: Aug. 25, 2000

(86) PCT No.: PCT/JP00/05773

§ 371 (c)(1),
(2), (4) Date: Feb. 25, 2002

(87) PCT Pub. No.: WO01/16413

PCT Pub. Date: Mar. 8, 2001

(30) Foreign Application Priority Data

Aug. 26, 1999 (JP) ..... 11-239519

(51) Int. Cl.[7] ..... D01F 6/00; B22D 28/00; B27B 17/00

(52) U.S. Cl. ..... 428/364; 428/395; 428/397; 264/130; 264/210.3

(58) Field of Search ..... 428/397, 364, 428/395; 264/103, 210.3

(56) References Cited

U.S. PATENT DOCUMENTS 2,939,202 A 6/1960 Holland
3,681,188 A 8/1972 Harris
6,423,407 B1 * 7/2002 Abe et al. ..... 428/395

FOREIGN PATENT DOCUMENTS

| | | |
|---|---|---|
| EP | 0 745 711 | 12/1996 |
| JP | 62097917 | 5/1987 |
| JP | 62268808 | 11/1987 |
| JP | 5-78904 | 3/1993 |
| JP | 9-3724 | 1/1997 |
| JP | WO 99/11709 | 3/1999 |
| JP | WO 99/11845 | 3/1999 |
| JP | 11-200143 | 7/1999 |
| JP | 11-302922 | 11/1999 |
| WO | WO01/16413 A1 * | 8/2001 |

* cited by examiner

*Primary Examiner*—N. Edwards
(74) *Attorney, Agent, or Firm*—Finnegan, Henderson, Farabow, Garrett & Dunner, L.L.P.

(57) ABSTRACT

The present invention is to provide a polytrimethylene terephthalate fiber having a trilobal type modified cross-section, composed of 95 mol % or more of trimethylene terephthalate repeating units and 5 mol % or less of other ester repeating units to have an intrinsic viscosity in a range from 0.7 to 1.3 (dl/g), wherein the outer periphery of the trilobal type cross-section consists of outwardly convex sections or of outwardly convex section and straight sections. According to the inventive method, it is possible to produce the above-mentioned fiber of the modified cross-section in an industrially stable manner while minimizing the adhesion of polymer scum to the spinning orifice or the contamination thereof to suppress the generation of fluff or yarn breakage.

7 Claims, 6 Drawing Sheets

POLY(TRIMETHYLENE TEREPHTHALATE) MODIFIED CROSS-SECTION YARN

TECHNICAL FIELD

The present invention relates to a polytrimethylene terephthalate fiber obtained by a melt spinning method and to a method for producing the same. More specifically, the present invention relates to a polytrimethylene terephthalate fiber having a trilobal cross-section suitable for the clothing use and a method for industrially producing such a modified cross-sectional fiber in a stable manner for a long period.

BACKGROUND ART

A polyethylene terephthalate (hereinafter referred to as PET) fiber having a modified cross-sectional shape such as a trilobal shape similar to a triangle has already been well-known in the art and is mass-produced on an industrial scale. In general, the modified cross-sectional PET fiber is produced by extruding a polymer either containing no titanium oxide used as a delusterant or containing a relatively small amount thereof in comparison with that in a polymer of a circular cross-section (generally called as a bright polymer) through a spinneret having Y or T-shaped spinning orifices or a modification thereof. The trilobal cross-sectional PET fiber containing a small amount of titanium oxide exhibits a silk-like elegant luster due to the combined effect of the brightness and the cross-sectional shape of the polymer. Accordingly, this fiber has been mass-produced as silky polyester fiber which is evaluated as a high grade product in the clothing field.

Strictly speaking, there are various kinds in the trilobal shape although they commonly have three corners in correspondence to three distal ends of the Y or T-shaped orifice of the spinneret. For instance, there are a group (i) in which an outer periphery of the trilobal cross-section consists of outwardly concave sections except for three corner portions (see FIG. 3); a group (ii) in which an outer periphery of the trilobal-cross-section consists of outwardly convex sections except for three corner portions (see FIG. 1); and a group (iii) in which an outer periphery of the trilobal cross-section is approximately a triangle (see FIG. 2).

On the other hand, the polytrimethylene terephthalate (hereinafter briefly referred to as 3GT) fiber is disclosed in the prior art documents such as (A). Japanese Unexamined Patent Publication No. 52-5320; (B) Japanese Unexamined Patent Publication No. 52-8123; (C) Japanese Unexamined Patent Publication No. 52-8124; (D) Japanese Unexamined Patent Publication No. 58-104216; (E) J. Polymer Science; Polymer Physics Edition vol. 14, pages 263 to 274 (1976); or (F) Chemical Fibers International vol. 45 (April), pages 110 to 111 (1995). According to the description in (F), the 3GT fiber is characterized in a lower Young's modulus and a higher elastic recovery of elongation (that is, a larger elastic limit) than those of PET fiber due.to its solid structure.

As described above, the PET fiber having a modified cross-sectional shape has been industrially mass-produced and various studies have been made on its cross-sectional shape. Contrarily, there are very few prior arts regarding the 3GT fiber having a modified cross-sectional shape. Japanese Unexamined Patent Publication No. 9-3724 (EP 745711 A1) discloses a 3GT fiber having a modified cross-sectional shape such as a trilobal shape, but this 3GT fiber having a modified cross-sectional shape described in this publication is a BCF fiber for producing a carpet yarn having a single-fiber size of 15 deniers (16.7 dtex) or more and is unsuitable for clothing use. Also, there is nothing but the term "trilobal" regarding the cross-sectional shape thereof, and the details of the shape are not described or suggested.

As described above, the prior art does not describe a 3GT fiber having a trilobal cross-section and a single-fiber size of 8.9 dtex (8 deniers) or less suitable for clothing use as well as the content of titanium oxide necessary for a silky 3GT fiber suitable for clothing use.

In the PET fiber having a modified cross-sectional shape, it has been known that an outer periphery is preferably of a trilobal outwardly concave cross-section to obtain a silky luster. However, the fiber having such a trilobal cross-section exhibits glitter which deteriorates the elegance. Thus, in the modified cross-sectional PET fiber, the trilobal cross-section is insufficient for obtaining the elegant silky luster and, instead, a more complicated multilobal cross-section such as a pentalobal or octalobal cross-section is necessarily adopted (see "Fiber Configuration" edited by the Fiber Society, pages 170 to 173 (1982)).

On the other hand, in addition to the difference in refractive index between 3GT and PET, a cross-sectional shape of 3GT fiber suitable for obtaining elegant luster and the relationship between the cross-sectional shape and the glossiness have not been known until now.

It is known that when polyester or polyamide is continuously melt-spun for a predetermined period, a contaminant composed of polymer decomposition product or others is adhered to the periphery of spinning orifices of the spinneret (generally called as a white-eye phenomenon or an eye-mucus phenomenon). Since such contaminant disturbs the smooth formation of fiber, fiber breakage increases to interrupt the spinning operation. Therefore, in the industrial sense, the surface of the spinneret is ordinarily wiped off at frequent intervals, to remove the contaminant, for the purpose of maintaining a smooth spinning operation. Since the spinning operation is interrupted by the wiping, the fiber production is disturbed. Accordingly, the interval between the respective wiping operations is preferably as long as possible in view of the operating efficiency and the yield of raw polymer.

A study has been made to prolong the wiping interval by mitigating the white-eye phenomenon. For example, Japanese Unexamined Patent Publication No. 5-78904 proposes the production of polyester fiber having a trilobal cross-section by using a spinning orifice of a modified Y-shaped opening as shown in FIG. 7 in which d/D is in a range from ⅓ to ⅔. In this regard, D is a length (mm) of a vertical line extending from a center of the trilobal orifice to one side of a circumscribed triangle of the outer periphery of the orifice opening, and d is a distance (mm) between the center and a cross point of the above-mentioned vertical line with the arcuate side.

Since the white-eye phenomenon is particularly significant in the case of 3GT fiber, Japanese Unexamined Patent Publication No. 11-200143 proposes to maintain a surface of the spinneret at a certain temperature, to apply a release agent thereto and to determine a polymer surface area per one orifice of the spinneret at a predetermined value for mitigating the white-eye phenomenon. However, there is neither description of how the white-eye phenomenon in a fiber having the modified cross-section occurs nor a suggestion of a countermeasure for mitigating the same.

DISCLOSURE OF THE INVENTION

A first object of the present invention is to provide a 3GT fiber having a uniform trilobal cross-section suitable for clothing, carpets or industrial use, which generates less fluff during the production process and the post-treatment process, and a method for continuously producing this modified cross-sectional fiber for a long period on an industrial scale.

A second object of the present invention is to provide a bright and silky 3GT fiber having a uniform cross-section and a single-fiber size of 8.9 dtex (8 deniers) or less suitable for the clothing use which generates less fluff during the production process and the post-treatment process such as a false-twist texturing process, a weaving or knitting process, and a method for continuously spinning this modified cross-sectional fiber for a long period on an industrial scale.

The inventors of the present invention have diligently studied to achieve the above-mentioned objects and found that there are problems in the production of 3GT fiber as follows:

In comparison with PET, 3GT is liable to generate polymer adhesion or contamination (a so-called white-eye or eye mucus phenomenon) in the vicinity a spinning orifice of a spinneret during the melt-spinning process. Accordingly, in the prior art, fiber breakage occurs in a very short time after starting the spinning, which makes it difficult to continue the spinning operation. Also, when the white-eye phenomenon has occurred, a cross-sectional shape of the resultant fiber having the modified cross-section is liable to vary, or fluff is liable to increase due to the filament breakage. These problems are not solved even though the spinneret having a modified Y-shaped orifice shown in FIG. 7 is used.

Also, the 3GT fiber exhibits a unique frictional characteristic in comparison with PET fiber, and has high coefficients of static and dynamic friction between fiber/fiber, fiber/metal, and fiber/ceramics. Thereby, the fiber breakage and fluff are liable to occur due to the friction during the drawing or post-treatment process. Particularly, this tendency is particularly true in a so-called bright polymer containing less of the titanium oxide used as a delusterant.

Further, the inventors of the present invention have found, as a result of diligent study, that it is possible to suppress the contamination of a spinning orifice with polymer (the white-eye or eye mucus phenomenon) and to prolong the wiping interval to as long as twelve hours or more by using a spinneret of a special configuration, more concretely closer to a triangle rather than a Y-shape, and limiting the spinning temperature, the surface temperature of the spinneret and the linear speed V of the extruded polymer to a specified range.

Also, it has been found that the fiber of the modified cross-section obtained from the inventive method has a uniform cross-sectional shape and the generation of fluff is less during treatment. Particularly, it has been found that if the content of titanium oxide in 3GT polymer is limited to the specified range, the frictional characteristic becomes proper when the 3GT polymer is used as a bright polymer, whereby the generation of fiber breakage or fluff is suppressed during the drawing and post-treatment process of the fiber having a trilobal cross-section. Simultaneously therewith, a silky luster is exhibited.

That is, the present invention is:

1. A 3GT fiber having a modified cross-section, composed of polytrimethylene terephthalate comprising 95 mol % or more of trimethylene terephthalate repeating units and 5 mol % or less of other ester repeating units, and having an intrinsic viscosity [η] in a range from 0.7 to 1.3 (dl/g), wherein the fiber has a trilobal cross-section in which the outer periphery consists solely of outwardly convex sections or both of outwardly convex sections and straight sections.
2. A 3GT fiber having a modified cross-section as defined by claim 1, wherein the fiber contains titanium oxide in a range from 0.03 to 0.15 wt %, and has a fiber size of 8.9 dtex (8 deniers) or less.
3. A 3GT fiber having a modified cross-section as defined by claim 1 or 2, wherein the modification degree is in a range from 1.15 to 1.35.
4. A 3GT fiber having a modified cross-section as defined by claim 1, 2 or 3, wherein the glossiness is in a range from 50 to 75.
5. A method for producing a 3GT fiber having a modified cross-section, comprising a step of extruding polytrimethylene terephthalate comprising 95 mol % or more of trimethylene terephthalate repeating units.and 5 mol % or less of other ester repeating units, and having an intrinsic viscosity [η] in a range from 0.7 to 1.3 (dl/g), through a spinneret having spinning orifices of a trilobal opening, wherein.
   i) the outer periphery of the trilobal cross-section comprises three semicircular corners and outwardly concave arcuate sections connecting every adjacent corner with the others, and all of the d/D values for three sides are in a range from 0.70 to 1.0 (wherein D is a length (mm) of a vertical line extending from a center of the trilobal orifice to one side of a circumscribed triangle in the outer periphery of the orifice opening, and d is a distance (mm) between the center and a cross point of the above-mentioned vertical line with the arcuate side);
   ii) a spinning temperature is in a range from 255 to 275° C.;
   iii) a surface temperature of the spinneret is in a range from 250 to 275° C.; and
   iv) a product of a linear speed V of the melted polymer extruded from the spinneret and the intrinsic viscosity [η] of 3GT; i.e., V×[η] is in a range from 4 to 13 (m/min) (dl/g).
6. A method for producing a 3GT fiber having a modified cross-section as defined by claim 5, wherein the 3GT contains titanium oxide in a range from 0.03 to 0.15 wt %.
7. A 3GT fiber having a modified cross-section obtained by a method defined by claim 5 or 6.

Figure 1:
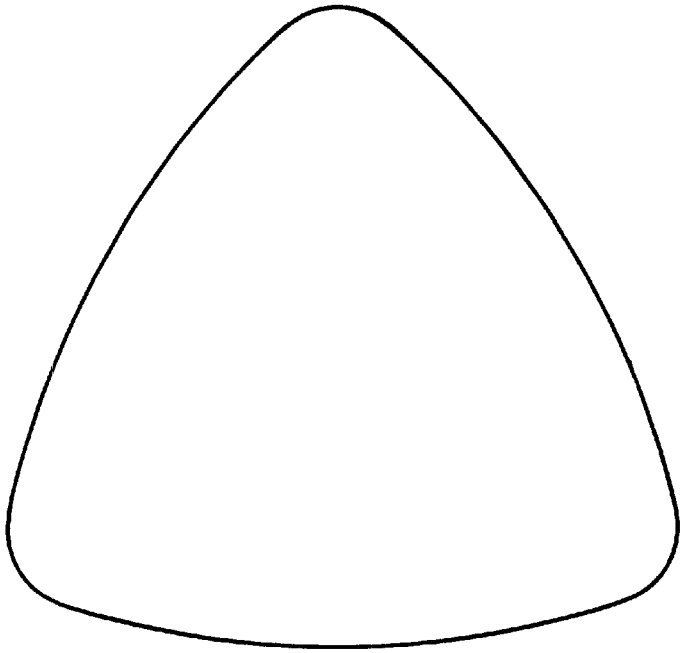
FIG. 1 is a diagrammatic view of a cross-section of a trilobal type 3GT fiber (Aspect 1; a rice ball type) taken by a microphotograph, illustrating the outer periphery consisting of outwardly convex sections.

DETAILED DESCRIPTION OF THE INVENTION.

The present invention will be described in more detail below.

In this regard, the explanation on the cross-sectional shape of a fiber having a modified cross-section is based on photographs taken according to microphotography described later.

A 3GT fiber according to the present invention is composed of 95 mol % or more of trimethylene terephthalate repeating units and 5 mol % or less of other ester repeating units and has an intrinsic viscosity [η] in a range from 0.7 to 1.3 (dl/g) and a trilobal type cross-section, an outer periphery of which consists solely of outwardly convex sections or both of outwardly convex sections and straight sections. The inventive modified cross-sectional 3GT fiber includes a multifilament and a staple fiber obtained by cutting the former.

The inventive 3GT is composed of 95 mol % or more of trimethylene terephthalate repeating units and 5 mol % or less of other ester repeating units. That is, the inventive 3GT includes a 3GT homopolymer, a homo 3GT and a copolymerized 3GT containing 5 mol % or less of other ester repeating units.

Examples of the copolymerized components are as follows:

An acidic component includes aromatic dicarboxylic acid represented by isophthalic acid or 5-sodium sulfoisophthalate, aliphatic dicarboxylic acid represented by adipic acid or itaconic acid. A glycolic component includes trimethylene glycol, ethylene glycol, polyethylene glycol or others. Also, it includes hydroxy-dicarboxylic acid such as hydroxy-benzoate. Further, a plurality of copoymerized components may be contained.

An intrinsic viscosity [η] of the inventive 3GT is in a range from 0.7 to 1.3 (dl/g). The intrinsic viscosity [η] is measured by a method described later. If the intrinsic viscosity [η] is less than 0.7 (dl/g), a strength at break of the fiber becomes 2.65 cN/dtex (3 g/d) or less which is too low to be put into practical use. Contrarily, if the intrinsic viscosity [η] exceeds 1.3 (dl/g), the dimensional stability of a multifilamentary yarn against heat is deteriorated, as well as a production cost of 3GT used as a raw material becomes higher. For the clothing use, the intrinsic viscosity [η] is preferably in a range from 0.8 to 1.1 (dl/g).

A delusterant such as titanium oxide, a heat stabilizer, an antioxidant, an antistatic agent, an ultraviolet screening agent, anti-fungus agent or various pigments may be contained in or copolymerized with the inventive 3GT.

Figure 2:
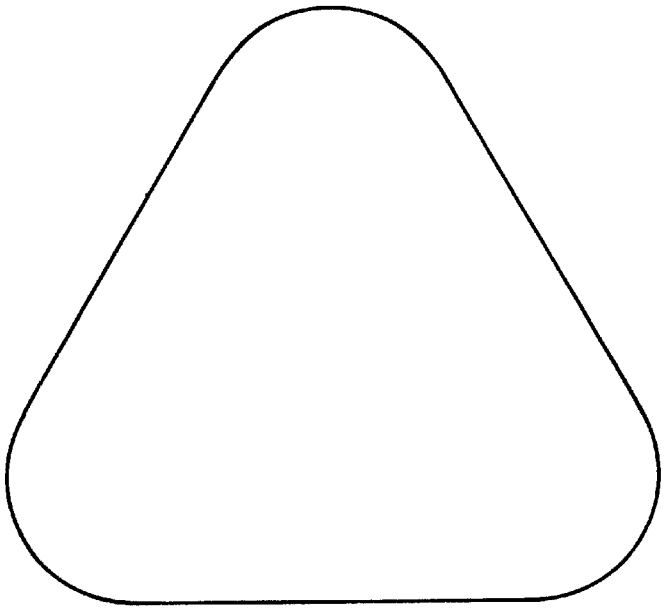
FIG. 2 is a diagrammatic view of a cross-section of a trilobal type 3GT fiber (Aspect 2; a rice ball type) taken by a microphotograph, illustrating the outer periphery consisting of outwardly convex sections and straight sections.

It is necessary that the inventive 3GT fiber has a trilobal type cross-section to provide a good feeling of touch and a silky luster. Further, the cross-section of the inventive 3GT fiber has the outer periphery consisting solely of outwardly convex sections or both of outwardly convex sections and straight sections (such a cross-sectional shape is hereinafter referred to as a rice ball type). FIGS. 1 and 2 illustrate examples of the rice ball type cross-sectional shape.

Figure 3:
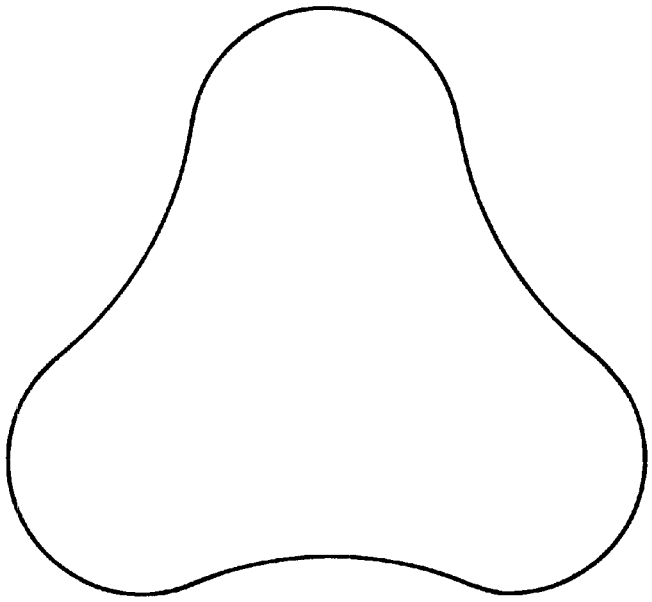
FIG. 3 is a diagrammatic view of a cross-section of a trilobal type 3GT fiber (Aspect 3) as comparative example (which is not the inventive trilobal type 3GT fiber) taken by a microphotograph, illustrating the outer periphery consisting of outwardly concave sections.

If a trilobal type cross-section has an outer periphery consisting of outwardly concave sections as shown in FIG. 3, the white-eye phenomenon is significant during the production of the-modified cross-sectional fiber. This substantially disables the spinning operation to be continued, and the resultant fiber has much fluff to make the knitting or weaving thereof difficult. Also, since 3GT has a different refractive index from that of PET, the 3GT fiber having the modified cross-section shown in FIG. 3, which is often seen in the PET fiber, is unsuitable for the clothing use due to its excessive glitter.

Contrarily, the modified cross-sectional fiber of a rice ball type shown in FIGS. 1 and 2 can be continuously spun for a long time, and is excellent in processibility in the knitting and weaving process. Also, it has a soft luster free from glitter and is most suitable for clothing use.

Figure 4:
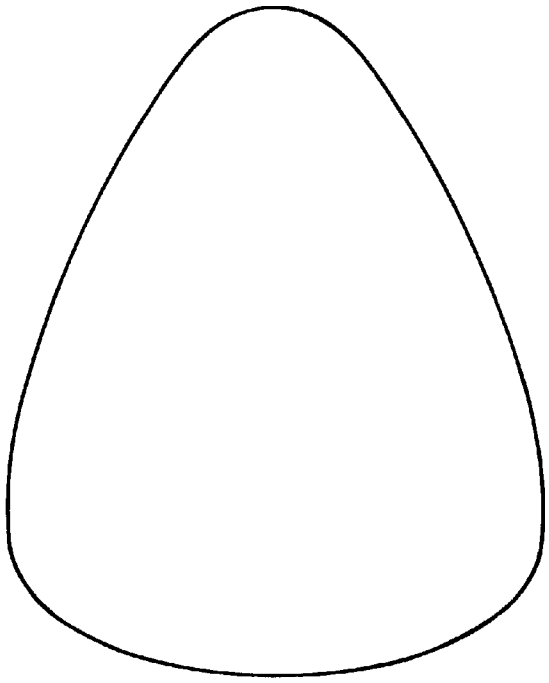
FIG. 4 is a diagrammatic view of one variation of the rice-ball type cross-section shown in FIG. 1 or 2 (Aspect 4; an equilateral triangular type)
Figure 5:
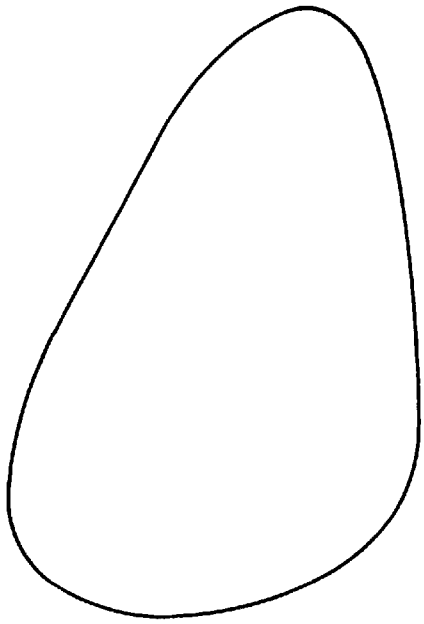
FIG. 5 is a diagrammatic view of another variation of the rice-ball type cross-section shown in FIG. 1 or 2 (Aspect 5; a type having three sides of different lengths)
Figure 6:
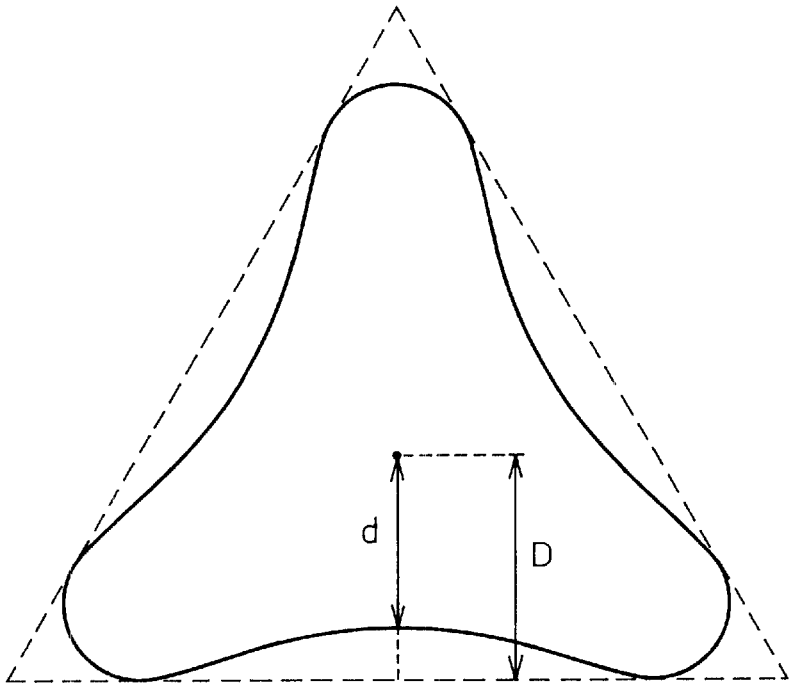
FIG. 6 is a diagrammatic view of one aspect of an opening of a spinning orifice (d/D=0.7 to 1.0) used for the present invention.
Figure 7:
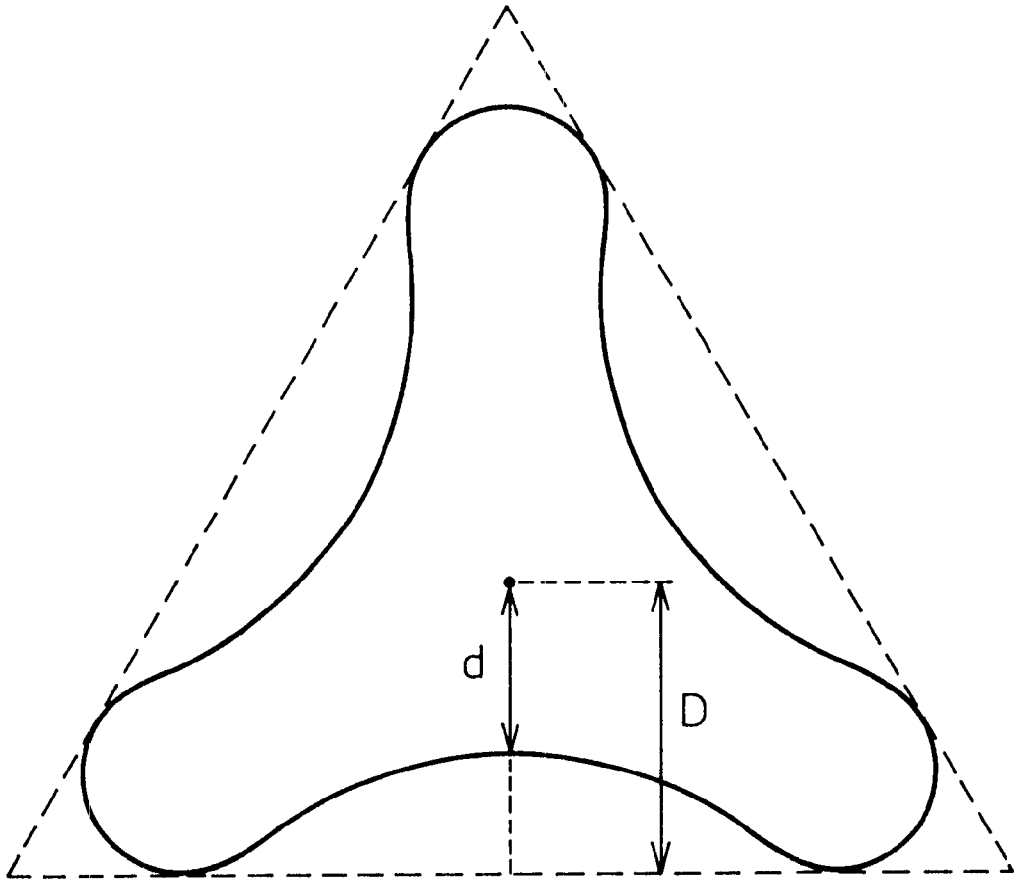
FIG. 7 is a diagrammatic view of one aspect of an opening of a spinning orifice (d/D=⅓ to ⅔) used in the prior art (Japanese Unexamined Patent Publication No. 5-78904)

The above-mentioned rice ball type cross-section may be either a regular triangle defined by three corners (FIG. 1), an equilateral triangle (FIG. 4) or a triangle having sides of different lengths (FIG. 5), and a degree of modification of the rice ball is preferably small (closer to a triangle) rather than large (closer to a circle).

While a single-fiber size of the inventive 3GT fiber having a modified cross-section is not particularly limited, 8.9 dtex (8 deniers) or less is preferable if it is used for the clothing. If the fiber size exceeds 8.9 dtex, a feeling of touch is liable to be hard. The size of fiber with soft touch suitable for clothing use is preferably 6.7 dtex (6 deniers) or less, more preferably in a range from 0.6 to 3.3 dtex (from 0.5 to 3 deniers).

While a content of titanium oxide in the inventive 3GT fiber having a modified cross-section is not particularly limited, it is preferably in a range from 0.03 to 0.15 wt %. Titanium oxide added to the fiber as a delusterant has an influence on a coefficient of friction. If the content is 0.03 wt % or less, the coefficient of friction becomes so high that the processibility of the fiber deteriorates in the spinning process or the post-treatment process. Also, the resultant product unfavorably glitters and is unsuitable for the clothing use in some cases. Contrarily, if the content of titanium oxide exceeds 0.15 wt %, the brightness disappears too much to result in a favorable silky luster. On account of preventing yarn breakage or fluff from generating in the spinning process and the post-treatment process as well as obtaining the silky luster in the resultant product, the content of titanium oxide is more preferably in a range from 0.03 to 0.09 wt %.

The inventive 3GT fiber preferably has a degree of modification measured by a method described later in a range from 1.15 to 1.35. If the degree of modification is less than 1.15, the glossiness becomes insufficient whereby the difference from that of a fiber having a circular cross-section is small. Contrarily, if the degree of modification exceeds 1.35, the white-eye phenomenon becomes significant during the spinning and the resultant fiber has much fluff and slack which is sometimes unsuitable for the post-treatment.

The inventive 3GT fiber is preferably has a glossiness measured by a method described later in a range from 50 to 75. If the glossiness is less than 50, the luster becomes insufficient whereby the difference from that of a fiber having a circular cross-section is small. Contrarily, if the glossiness exceeds 75, the luster becomes so significant that the fiber may be unsuitable for the clothing use. The glossiness is more preferably in a range from 55 to 70, further more preferably from 60 to 70. The preferable glossiness is achievable from a suitable combination of the content of titanium oxide with the degree of modification.

The inventive 3GT fiber is favorably obtained by a method for producing a 3GT fiber having a modified cross-section, comprising a step of extruding polytrimethylene terephthalate comprising 95 mol % or more of trimethylene terephthalate repeating units and 5 mol % or less of other ester repeating units, and having an intrinsic viscosity [η] in a range from 0.7 to 1.3 (dl/g), through a spinneret having spinning orifices of a trilobal opening, wherein i) the outer periphery of the trilobal cross-section comprises three semicircular corners and outwardly concave arcuate sections connecting every adjacent corner with the others, and all of the d/D values for three sides are in a range from 0.70 to 1.0 (wherein D is a length (mm) of a vertical line extending from a center of the trilobal orifice to one side of a circumscribed triangle in the outer periphery of the orifice opening, and d is a distance (mm) between the center and a cross point of the above-mentioned vertical line with the arcuate side);

ii) a spinning temperature is in a range from 255 to 275° C.;

iii) a surface temperature of the spinneret is in a range from 250 to 275° C.; and iv) a product of a linear speed V of the molten polymer extruded from the spinneret and the intrinsic viscosity [η] of 3GT; i.e., V×[η] is in a range from 4 to 13 (m/min) (dl/g).

According to the inventive producing method, for the purpose of decreasing the occurrence of white-eye phenomenon and obtaining a fiber having a uniform modified cross-section in a stable manner for a long period, the outer periphery of the trilobal type orifice of the spinneret consists of three semicircular corners and outwardly concave arcuate sections connecting every adjacent corner with the others wherein all of the d/D values are in a range from 0.70 to 1.0. In the trilobal type orifice for obtaining the fiber having the cross-section shown in FIG. 4 or 5, three d/D values are different from each other. If d/D exceeds 1.0 or the arcuate section is outwardly convex, the resultant fiber has a generally circular cross-section and cannot be referred to as a modified cross-sectional fiber. A preferable range of d/D is from 0.70 to 0.90.

According to the inventive producing method, a spinning temperature is in a range from 255 to 275° C. In this regard, the spinning temperature is a temperature within a spin pack 5 (see FIG. 8) which is the same as a temperature of melted 3GT prior to being spun. Generally speaking, 3GT is liable to be decomposed by heating in comparison with PET, and therefore, if the spinning temperature exceeds 275° C. as in the spinning of PET, a smooth spinning is not expected due to the bending of fiber or the generation of bubbles of decomposition gas, whereby the resultant fiber is inferior in physical properties. Contrarily, if the spinning temperature is lower than 255° C., a smooth spinning operation becomes difficult due to melt fracture or others even if other conditions have been favorably prepared. This is because the viscosity of the melted polymer becomes extremely high as a the spinning temperature lower than 255° C. is close to the melting point of 3GT. The spinning temperature is preferably in a range from 255 to 270° C. which is completely free from both of melt fracture and heat decomposition problems.

In the inventive producing method, a surface temperature of a spinneret is in a range from 250 to 275° C. The present inventors have found at the first time in the world that the white-eye phenomenon due to the adhesion of polymer in the vicinity of the spinning orifice is liable to generate as the surface temperature of the spinneret is lower. If.the surface temperature of the spinneret is lower than 250° C., the white-eye phenomenon is significant to make the continuation of the spinning operation impossible. Contrarily, if the surface temperature of the spinneret exceeds 275° C., the size variation U % of a multifilamentary yarn becomes problematically large to cause a fiber quality to deviate from a proper range in view of the white-eye phenomenon and the size variation U %, the surface temperature of the spinneret is preferably in a range from 255 to 270° C., more preferably from 258 to 270° C.

Figure 8:
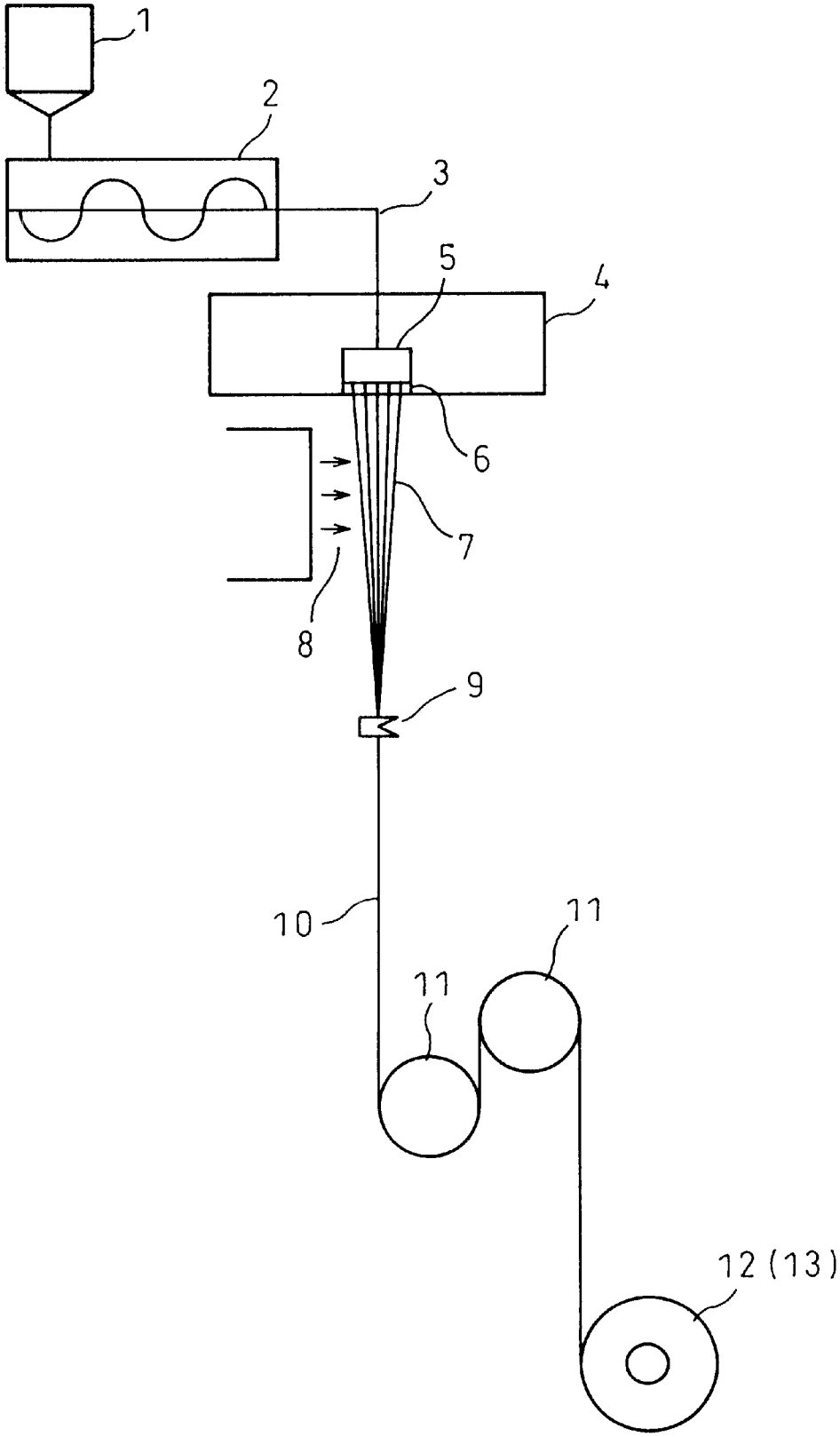
FIG. 8 is a schematic view of an example of a spinning apparatus used for producing the inventive trilobal type 3GT fiber.

As apparent from FIG. 8, since a spinneret 6 is built in the spin pack 5 usually installed in a spin head 4, the surface temperature of the spinneret varies in relation to the spinning temperature (a spin head temperature) to be generally lower by 5 to 15° C. than the latter.

Alternatively, the surface temperature of the spinneret may be adjusted independently from the spinning temperature by positively heating the spinneret or the atmosphere directly beneath the spinneret.

According to the inventive producing method, a product of a linear speed V of the molten polymer extruded from the spinneret and the intrinsic viscosity [η]; i.e., V×[η] must be in a range from 4 to 13 (m/min) (dl/g). If the product V×[η] is less than 4 (m/min) (dl/g), the extruded polymer is not evenly thinned during the fiber formation. That is, there is a lengthwise irregularity in size of the resultant fiber (i.e., the fiber has a large U %). Contrarily, if the product V×[η] exceeds 13 (m/min) (dl/g), the white-eye phenomenon becomes significant to disturb the continuous spinning operation. On account both of U % and the white-eye phenomenon, the product V×[η] is preferably in a range from 4 to 9 (m/min) (dl/g).

In this regard, the linear speed V of the melted polymer extruded from the spinneret is a function of an extrusion area of the orifice.and an extrusion rate of the polymer per orifice and is calculated by the following equation (1):

$$V(\text{cm/min})=(X/\rho)/Y \quad (1)$$

wherein X represents the extrusion rate of the polymer per orifice (g/min), Y represents the extrusion area of the orifice ($cm^2$) and ρ represents a density of melted 3GT ($g/cm^3$) which is 1.15 $g/cm^3$.

Usually, since a single fiber size which is identical to the extrusion rate X of the polymer per orifice is initially determined, the linear speed V of the melted polymer extruded from the orifice is adjusted by regulating the extrusion area of the orifice.

According to the inventive producing.method, the content of titanium oxide in 3GT is preferably in a range from 0.03 to 0.15 wt %. The reason therefor and the preferable range thereof are the same as those already described on the modified cross-sectional fiber.

One aspect of a method for producing the inventive modified cross-sectional 3GT fiber will be explained with reference to FIGS. 8 and 9.

First, as shown in FIG. 8, 3GT pellets defined by the present invention are continuously put into a continuous pellet drier 1 and dried with hot air so that the moisture content is 30 ppm. The dried pellets are subsequently fed to an extruder 2 maintained at a temperature in a range from 255 to 265° C., heated to a temperature above the melting point of 3GT and melted. Thereafter, the melted 3GT is fed to a spin head 4 maintained at a predetermined temperature via a bend 3, adjusted to the spinning temperature and filtrated in the spin pack 5.

Thereafter, the melted 3GT is extruded through a spinneret 6 having trilobal type orifices to form a multifilamentary yarn 7 of modified cross-sectional fibers. The extruded 3GT multifilamentary yarn 7 is then introduced into a cooling zone and thinned to a predetermined fiber size by the withdrawing force of godet rolls 11 rotating at a peripheral speed of 500 m/min or more while being cooled to a room temperature by a cooling air 8, during which a finishing agent is imparted thereto through an oiling nozzle 9, whereby an undrawn yarn 10 of multifilamentary fibers having a modified cross-section is obtained. The undrawn yarn 10 is taken up by a winder 12 to form an undrawn yarn package 13.

Figure 9:
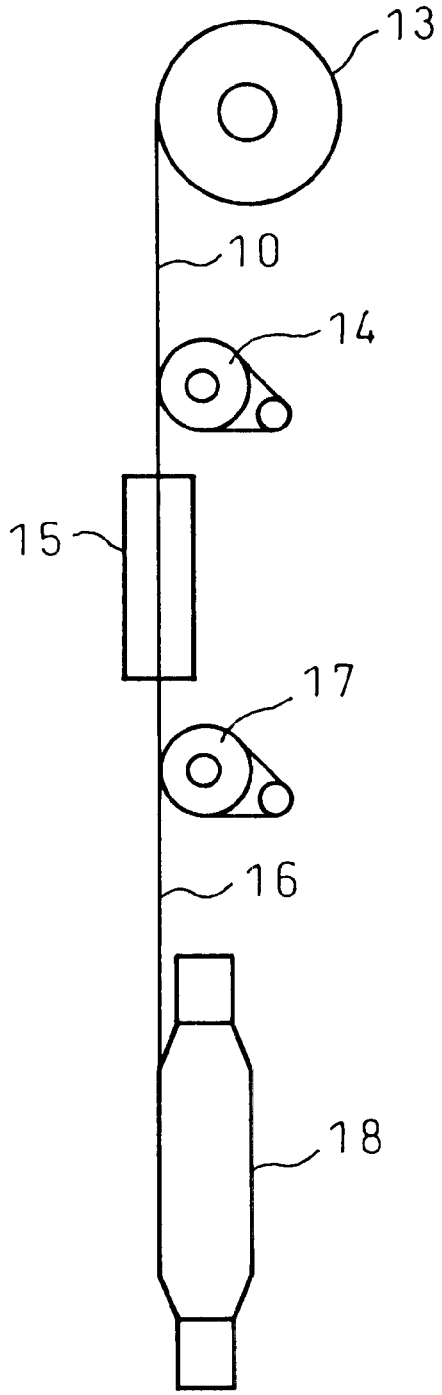
FIG. 9 is a schematic view of an example of a drawing machine used for producing the inventive trilobal type 3GT fiber.

Then, the undrawn yarn package 13 is transferred to a drawing machine shown in FIG. 9. After being heated by a feed roll 14 at a temperature in a range from 45 to 65° C., the undrawn yarn 10 is drawn at a predetermined draw ratio and heat-treated with a hot plate 15 maintained at a temperature in a range from 100 to 150° C. to be a drawn yarn 16. The draw ratio is defined by a ratio in speed between the-feed roll 14 and a draw roll 17. The resultant drawn yarn 16 is wound either in a pirn form of a twisted yarn or in a cheese form of a non-twisted yarn, in accordance with the need.

The measurement, evaluation and observation of a cross-sectional shape used in the present invention will be described below.

(a) Intrinsic Viscosity [η]

The intrinsic viscosity [η] is a value defined by the following equation (2):

$$[\eta] = \lim_{C \to 0}(\eta r - 1)/C \quad (2)$$

wherein ηr is referred to as a relative viscosity obtained by dividing a viscosity of a solution of 3GT polymer dissolved in o-chlorophenol of 98% purity or more and diluted to have a predetermined polymer concentration C (g/100 ml) measured at 35° C. by a viscosity of the solvent measured at the same temperature.

Values of the relative viscosity are measured on several polymer concentrations C, and the intrinsic viscosity [η] is obtained by extrapolating C to zero.

(b) Cross-sectional Photograph of Fiber

The yarn is embedded in melted paraffin, which is left for about five minutes and solidified. Thereafter, the embedded sample is cut, vertical to the fiber axis, by a microtome to obtain a cut piece of 5 to 7 μm thick. Then, the cut piece is placed on a slide glass which is heated to melt the paraffin. Thereafter, one drop of olive oil is dropped thereon and pressed by a cover glass.

Next, a cross-section of the fiber is observed and photographed by using an optical microscope (manufactured by Olympus Kogaku Kogyo K.K.; a trade name "BH-2"-Type B071) to obtain a cross-sectional photograph. The magnification is selected within a range from 200 to 500 as necessary.

(c) Degree of Modification

A radius r of a maximum inscribed circle for the cross-section and a radius R of a minimum circumscribed circle therefor are measured from the cross-sectional photograph taken in accordance with the above-mentioned method (b), and substituted into the following equation (3):

$$\text{Degree of modification} = R/r \quad (3)$$

(d) Glossiness

A machine-made paper is adhered to an aluminum plate of 7 cm long, 5 cm wide and 1 mm thick, and a yarn is wound around the same to form six layers under a load of 1 cN/dtex. A winding pitch is 100 end/cm while taking care not to generate a gap. Thus, a sample fiber plate is obtained.

A glossiness of the sample fiber plate at a measurement angle 60 degrees is measured by using a variangular type digital glossmeter (UGV-4D type; manufactured by Suga Shikenki K.K.) in accordance with JIS-1013 (B method). The measurement is carried out both on front and back surfaces of the sample fiber plate, and an average value of the two is used as the glossiness. [Examples 1 to 3 and Comparative examples 1 to 4]

A trilobal cross-section type multifilamentary yarn of 38.9 dtex (35 deniers)/24 filaments was test-produced from 3GT bright pellets containing 0.05 wt % of titanium oxide and having the intrinsic viscosity [η] of 0.90 (dl/g) by using a spinning apparatus and a drawing machine shown in FIGS. 8 and 9.

In this test, the influence of the product V×[η] of the linear speed V of the polymer extruded from a Y-shaped orifice of a spinneret and the intrinsic viscosity [η] of the 3GT on the modified fiber cross-section of the multifilamentary yarn, the generation of the white-eye phenomenon and the time period for which the spinning operation is continued in a stable manner was studied.

The spinning apparatus could be simultaneously provided with sixteen spinnerets.

In the respective example, sixteen undrawn yarns were simultaneously spun which were doffed four times, respectively, as packages of 5 kg weight. This means that the spinning operation continuously lasts for 26 hours unless there is a yarn breakage.

In the subsequent drawing process, the sixteen undrawn yarn packages in the same doff were simultaneously supplied to a drawing machine, wherein two drawn yarn packages of 2.5 kg weight were obtained from one undrawn yarn package. Such a drawing process was repeated four times (corresponding to the four doffs of the undrawn yarn).

In each of Examples and Comparative examples, one of eight kinds of spinning orifices (A to H) shown in Table 1 was used for the test.

The respective spinning orifice is of a regular-triangle type wherein the value of d/D common to three sides thereof is shown in Table 1.

In this test, the following points were evaluated on the eight kinds (A to H) of the spinning orifice shown in Table 1:

(1) The cross-sectional shape and the degree of modification of a fiber in a multifilamentary yarn (2) The contamination in the vicinity of spinning orifice (degree of white-eye phenomenon) after 24 hours from the initiation of spinning (3) Yield of the respective doff of the drawing process (4) Glossiness and luster of the resultant yarn (5) Knittability of the resultant yarn (Spinning condition)

Drying temperature and final moisture content of pellet: 130° C., 25 ppm

Extruder temperature: 260° C.

Spinning temperature: 265° C.

Polymer extrusion rate: 12.9 g/min/end

Surface temperature of spinneret: 253° C.

Cooling air condition: temperature of 22° C., relative humidity of 90%

Finishing agent: 10 wt % aqueous emulsion

Pickup of finishing agent: 0.8 wt %

Take-up speed of undrawn yarn (peripheral speed of godet roll): 1500 m/min

Winding speed: adjustment is carried out so that a winding tension becomes 0.07 cN/dtex (0.08 g/d).

Winding weight of undrawn yarn: 5 kg/package (Drawing condition)

Feed roll temperature: 55° C.

Hot plate temperature: 130° C.

Drawing roll temperature: non-heated (room temperature)

Draw ratio: adjustment is carried out so that an elongation at break of the resultant yarn is approximately 40%.

Winding speed: 800 m/min

Winding weight of drawn yarn: 2.5 kg/pirn

After the spinneret has been wiped off prior to initiating the spinning, the spinning test was carried out and the results are shown in Tables 1 and 2.

The cross-sectional shape of the fiber in the resultant multifilamentary yarn was a FIG. 3 type in the spinning orifices A, B, C and G (Comparative examples 1, 2, 3 and 4); a FIG. 2 type in the spinning orifice F (Example 3); and a FIG. 1 type in the spinning orifices D, E and H (Examples 1, 2 and 4). In this connection, the FIG. 1 type means that the cross-sectional shape looks like that shown in FIG. 1 and so on.

According to an observation with the naked eye, it was found that, in the spinning orifices A and B, the contamination in the vicinity of the spinning orifice on the spinneret began directly after the initiation of spinning and developed with time, and the white-eye phenomenon became significant in the second doff, making it impossible to further continue the spinning operation because of the increase in yarn breakage.

In the spinning orifices C and G, it was found that the contamination began three hours after the initiation of the spinning and developed with time, and the white-eye phenomenon became significant in the third doff, making it impossible to further continue the spinning operation because of the increase in yarn breakage.

In the spinning orifices D, E, F and H, the white-eye phenomenon was relatively slight within 25.6 hours, making it possible to continue the spinning operation at least until the fourth doff.

The undrawn yarns thus obtained were drawn and the yield thereof in the drawing process is shown in Table 2.

The yield of drawing process was calculated by the following equation (4):

$$\text{Yield of drawing process}=100\times[16-(\text{the number of yarn breakage})]/16 \quad (4)$$

As the criterion of the yield of drawing process, that in the drawing doff No. 2—2 which is carried out 12.8 hours after the initiation of the drawing process was adopted such that, if it is 93.8% or higher, the yield is "very good"; if 81.3% or higher, the yield is "good"; and if less than 81.3%, the yield is "not good".

In Comparative examples 1 to 4, since the continuation of the spinning operation became impossible or the yield reduced to a great extent in a period shorter than 12 hours from the initiation, it is impossible to extend the wiping period to 12 hours or more if the spinneret having the spinning orifice A, B, C or G is used.

Contrarily, in Examples 1 to 4, no yarn breakage occurred even though the spinning operation lasts for 24 hours or more and the yield of the drawing process is also maintained at 87.5% or more even after 15 hours or more.

Since the wiping period could be 12 hours or more under the condition of Examples 1 to 4, the industrial production may be possible under such a condition.

The luster of the resultant yarn was evaluated, and it was found that Example 4 having an approximately circular cross-section is slightly poor in luster, while Comparative examples 1 to 4 are high in luster but unfavorably glitter. In this regard, the luster is evaluated according to the sensory test made on a tubular knit fabric by three experts wherein ○ represents "good", Δ represents "ordinary" and × represents "not good".

When warp knit fabrics were prepared by using these yarns, it was found that the number of machine stoppages was less in Examples 1 to 4, but more in Comparative examples 1 to 4 and were unsuitable for practical use.

The knittability was evaluated by the number of machine stoppages when the warp knitting machine operates one day under the following condition, wherein ○ represents "good", Δ represents "ordinary" and × represents "not good":

Knitting machine: a tricot machine of 28 gauges

Knitting stitch: a tricot half

Runner length: front read: 132 cm/480 courses
back read: 100 cm/480 courses

TABLE 1

| | Kind of spinneret | d/D | Area of spinning orifice ($mm^2$) | Linear speed of extruded polymer (m/min) | V × [η] | Cross-sectional shape of filament | Contamination of spinning orifice | Degree of modification | Glossiness | Luster | Knittability |
|---|---|---|---|---|---|---|---|---|---|---|---|
| Comparative example 1 | A | 0.61* | 0.030 | 16.3 | 14.7* | FIG. 3 type | Significantly | 1.58 | 78.0 | x | x |
| Comparative example 2 | B | 0.78 | 0.030 | 16.3 | 14.7* | FIG. 3 type | Significantly | 1.50 | 76.0 | x | Δ |
| Comparative example 3 | C | 0.65* | 0.038 | 12.9 | 11.6 | FIG. 3 type | Significantly | 1.49 | 76.0 | x | x |
| Example 1 | D | 0.85 | 0.038 | 12.9 | 11.6 | FIG. 1 type | Slightly | 1.28 | 63.5 | ○ | ○ |
| Example 2 | E | 0.79 | 0.045 | 10.9 | 9.8 | FIG. 1 type | Slightly | 1.30 | 63.5 | ○ | ○ |
| Example 3 | F | 0.72 | 0.096 | 5.9 | 5.0 | FIG. 2 type | Slightly | 1.35 | 65.5 | ○ | ○ |
| Comparative example 4 | G | 0.55* | 0.096 | 5.9 | 5.0 | FIG. 3 type | Significantly | 1.55 | 77.0 | x | x |
| Example 4 | H | 0.95 | 0.096 | 5.9 | 5.0 | FIG. 1 type | Slightly | 1.16 | 57.0 | Δ | ○ |

Note.
* indicates a value was out of a scope the invention.

TABLE 2

| | Doffing No. Of spinning | | | | | | | |
|---|---|---|---|---|---|---|---|---|
| | 1 0–6.4 hr* | | 2 6.4–12.8 hr* | | 3 12.8–19.2 hr* | | 1 19.2–25.6 hr* | |
| | Doffing No. of drawing | | | | | | | |
| Spinneret | 1-1 | 1-2 | 2-1 | 2-2 | 3-1 | 3-2 | 4-1 | 4-2 |
| A Comparative example 1 | 12.5 | | | | | | | |
| B Comparative example 2 | 43.8 | 18.8 | | | | | | |
| C Comparative example 3 | 87.5 | 75 | 43.8 | | | | | |
| D Example 1 | 100 | 93.8 | 93.8 | 93.8 | 87.5 | 56.2 | 87.5 | 62.5 |
| E Example 2 | 100 | 100 | 93.8 | 100 | 93.8 | 100 | 93.8 | 93.8 |
| F Example 3 | 100 | 100 | 93.8 | 100 | 100 | 93.8 | 100 | 93.8 |
| G Comparative example 4 | 93.8 | 75 | 50 | 25 | | | | |

TABLE 2-continued

| | Doffing No. Of spinning | | | | | | | |
|---|---|---|---|---|---|---|---|---|
| | 1 0–6.4 hr* | | 2 6.4–12.8 hr* | | 3 12.8–19.2 hr* | | 1 19.2–25.6 hr* | |
| | Doffing No. of drawing | | | | | | | |
| Spinneret | 1-1 | 1-2 | 2-1 | 2-2 | 3-1 | 3-2 | 4-1 | 4-2 |
| H Example 4 | 100 | 100 | 100 | 100 | 93.8 | 100 | 93.8 | 100 |

Note 1:
Vacant column represents no undrawn yarn was obtained or the test was interrupted because a continuation thereof was not necessary.
Note 2:
Yield of drawing process was calculated by using equation (4) (unit: %).
* represents a time lapse from the initiation of spinning of undrawn yarn.

EXAMPLE 5 AND COMPARATIVE EXAMPLES 5 TO 7

A test was conducted in the same manner as in Example 3 except for varying the spinning temperature and the surface temperature. The results are shown in Table 3.

In Comparative example 5, the melt fracture occurred because the spinning temperature is low, and the low.

In Comparative example 6 wherein the spinning temperature is high, while no contamination occurred in the spinning orifice, the yarn largely bent to cause much yarn breakage during the spinning operation.

In Example 5 wherein the spinning temperature is 270° C., the spinning state and the contamination of the spinneret were favorable.

In Comparative example 7 wherein the surface temperature of the spinneret is higher by using a spinneret heater, although there was no contamination in the spinning orifice, both of the yarn breakage and U % are unfavorable.

TABLE 3

| | Spinning temperature (° C.) | Surface temperature of spinneret (° C.) | Spinning state | Contamination of spinning orifice | U % (%) |
|---|---|---|---|---|---|
| Comparative example 5 | 250 | 240 | Melt fracture | Significantly | — |
| Example 5 | 270 | 258 | Good | Slightly | 1.0 |
| Comparative example 6 | 280 | 268 | Fiber largely bent | Slightly | 1.3 |
| Comparative example 7 | 270 | 280 | Fiber largely bent | Slightly | 2.5 |

EXAMPLES 6 TO 8

A spinning test was conducted in the same manner as in Example 3 except for varying the content of titanium oxide. The glossiness, the luster and the yield of the drawing process (in No. 2—2 of the drawing doff) were evaluated in the resultant fiber. The results are shown in Table 4.

As shown in Table 4, Example 6, wherein the content of titanium oxide is 0.01 wt %, had a higher glossiness than that of Example 7, wherein the content of titanium oxide is 0.05 wt %, and unfavorably glittered, as well as the yield of the drawing process was also somewhat lowered in comparison with Example 7.

TABLE 4

| | Content of titanium oxide (%) | Glossiness | Luster | Yield of Drawing process (%) |
|---|---|---|---|---|
| Example 6 | 0.01 | 73 | Δ | 87.5 |
| Example 7 | 0.05 | 65.5 | ○ | 100 |
| Example 8 | 0.3 | 51 | Δ | 100 |

CAPABILITY OF EXPLOITATION IN INDUSTRY

The inventive 3GT fiber having a trilobal type modified cross-section is suitable for clothing, subsistence stores and industrial uses because it generates less fluff and fiber breakage during the production as well as is excellent in processibility in the post-treatment thereof. Particularly, a bright type fiber of the modified cross-section having a fiber size of 8.9 dtex (8 deniers) or less, and never obtained before, is most suitable for clothing use because of its silky luster.

According to the inventive producing method, it is possible to largely minimize the polymer adhesion or contamination (white-eye phenomenon) of the spinning orifice of the spinneret and prolong the wiping period to twelve hours or longer. Particularly, when the 3GT fiber is produced, having the modified cross-section composed of bright polymer suitable for the clothing use, fluff or yarn breakage are largely reduced during the drawing process because of the improvement in frictional characteristics thereof.

The present invention makes it possible to continuously produce a 3GT fiber having a modified cross-section of a trilobal type particularly suitable for clothing use under industrially stable conditions.

What is claimed is:

1. A polytrimethylene terephthalate fiber having a modified cross-section, composed of polytrimethylene terephthalate comprising 95 mol % or more of trimethylene terephthalate repeating units and 5 mol % or less of other ester repeating units, and having an intrinsic viscosity [η] in a range from 0.7 to 1.3 (dl/g), wherein the fiber has a trilobal cross-section in which the outer periphery consists solely of outwardly convex sections or both of outwardly convex sections and straight sections.

2. A polytrimethylene terephthalate fiber having a modified cross-section as defined by claim 1, wherein the fiber contains titanium oxide in a range from 0.03 to 0.15 wt %, and has a fiber size of 8.9 dtex (8 deniers) or less.

3. A polytrimethylene terephthalate fiber having a modified cross-section as defined by claim 1 or 2, wherein the modification degree is in a range from 1.15 to 1.35.

4. A polytrimethylene terephthalate fiber having a modified cross-section as defined by claim 1, 2 or 3, wherein the glossiness is in a range from 50 to 75.

5. A method for producing a polytrimethylene terephthalate fiber having a modified cross-section, comprising a step of extruding polytrimethylene terephthalate comprising 95 mol % or more of trimethylene terephthalate repeating units and 5 mol % or less of other ester repeating units, and having an intrinsic viscosity [η] in a range from 0.7 to 1.3 (dl/g), through a spinneret having spinning orifices of a trilobal opening, wherein i) the outer periphery of the trilobal cross-section comprises three semicircular corners and outwardly concave arcuate sections connecting every adjacent corners with the others, and all of the d/D values for three sides are in a range from 0.70 to 1.0 (wherein D is a length (mm) of a vertical line extending from a center of the trilobal orifice to one side of a circumscribed triangle in the outer periphery of the orifice opening, and d is a distance (mm) between the center and a cross point of the above-mentioned vertical line with the arcuate side);

ii) a spinning temperature is in a range from 255 to 275° C.;

iii) a surface temperature of the spinneret is in a range from 250 to 275° C.; and iv) a product of a linear speed V of the melted polymer extruded from the spinneret and the intrinsic viscosity [η] of polytrimethylene terephthalate; i.e., V×[η] is in a range from 4 to 13 (m/min) (dl/g).

6. A method for producing a polytrimethylene terephthalate fiber having a modified cross-section as defined by claim 5, wherein the 3GT contains titanium oxide in a range from 0.03 to 0.15 wt %.

7. A polytrimethylene terephthalatefiber having a modified cross-section obtained by a method defined by claim 5 or 6.

* * * * *